United States Patent [19]

Kosta

[11] 4,029,833

[45] June 14, 1977

[54] WEB COATING APPARATUS

[75] Inventor: Geza Kosta, Plainfield, N.J.

[73] Assignee: Midland-Ross Corporation, Cleveland, Ohio

[22] Filed: Apr. 11, 1975

[21] Appl. No.: 567,295

[52] U.S. Cl. ..... 427/428; 118/249; 118/253; 118/259; 118/261; 118/262

[51] Int. Cl.[2] ..... B05D 1/28

[58] Field of Search ..... 427/428; 118/262, 261, 118/259, 249, 253, 255

[56] References Cited

UNITED STATES PATENTS

| | | | |
|---|---|---|---|
| 2,772,184 | 11/1956 | Wolfe et al. | 427/428 |
| 3,158,497 | 11/1964 | Fird et al. | 427/428 |
| 3,511,696 | 5/1970 | Murray | 427/428 |

*Primary Examiner*—Ronald H. Smith
*Assistant Examiner*—Janyce A. Bell
*Attorney, Agent, or Firm*—Woodrow W. Portz

[57] ABSTRACT

Apparatus and method for applying extremely thin coatings of liquid materials entering the apparatus at a viscosity in the range of up to 10,000 centipoises absolute viscosity through a combination of factors involving the use of at least four rolls of desired physical characteristics and roll speeds to continuously extract a relatively thick film from a pool of the liquid, reduce it to an ultra thin coating free of discontinuities, and unite the thin coating with a web.

6 Claims, 4 Drawing Figures

WEB COATING APPARATUS

BACKGROUND OF THE INVENTION

Webs having a release coating on one or both sides are a typical example of the use of the present invention. Such webs are applied, for example, to adhesive surfaces of pressure sensitive tapes, "stick on" tile, two-faced tapes, and numerous other articles having an adhesive surface to protect until actual use. It is found that extremely thin coatings in the order 0.0001 to 0.00001 of an inch will suffice, especially when the release agent is as effective as certain liquid silicone polymers now available. These relatively high cost materials are economical as release agents only if they can be applied in substantially thinner coatings than can be applied by conventional coating machinery. Moreover, as the cost of paper fiber and other web forming materials is significant in the preparation of protective webs, the machinery for applying such ultra thin coatings is desirably capable of forwarding light-weight low-strength webs through the coating operation without any tearing or scuffing of the webs.

A particular difficulty that arises in the application of extremely thin coatings to webs is the attainment of an essentially continuous coating free of open spots which expose the surface of the web. Many coating compositions are extremely difficult to apply in a very thin uniform layer without any discontinuity. On the other hand, there are coaters which can meter a very thin film but in the process aerate the film and thus cause the film to rupture during deposition on the web.

SUMMARY OF THE INVENTION

The present invention is embodied in apparatus and process for drawing a layer of liquid having a viscosity in the range of up to 10,000 centipoises absolute viscosity and a thickness in the range of 0.0005 and upwards from a quiescent pond thereof by means of a "metering" roll and an "applicator" roll in nip relationship, and reducing the thickness of the initial layer to a thickness of one tenth to one twentieth or less by passage through the nip of the applicator roll with a "coating" roll, and then applying the film of reduced thickness from the periphery of a coating roll to a web supported there against by a backing roll traveling at the same speed as the coating roll. An important feature of the process is to first form the film in a manner which avoids the introduction of gas bubbles into the film. Accordingly, the layer of coating material is initially formed in its thickest condition to an extremely accurate thickness by metal nip-forming rolls, i.e., the metering and applicator rolls, finished with an accuracy providing such surface uniformity as to result in roll spacing or a nip-gap having a width variation or tolerance of, e.g., 0.0002 of an inch. For purposes of this invention, the metering and applicator rolls must be rotatable to a surface accuracy within their nip of less than 0.0002 of an inch. Thus, if a web is to be coated at the speed of 1000 feet per minute, the film or layer is initially formed at a rate in the approximate range of 40 to 200 feet per minute. Lesser web speeds call for proportionally lower roll speeds throughout the series of rolls.

The coating roll, provided with a resilient surface in nip relation with the applicator roll which also has a resilient surface, rotates at a peripheral speed of 5 to 25 times greater than that of the applicator roll. The peripheries of both rolls traverse the nip therebetween in the same direction.

DESCRIPTION OF THE PREFERRED EMBODIMENT

Figure 1:
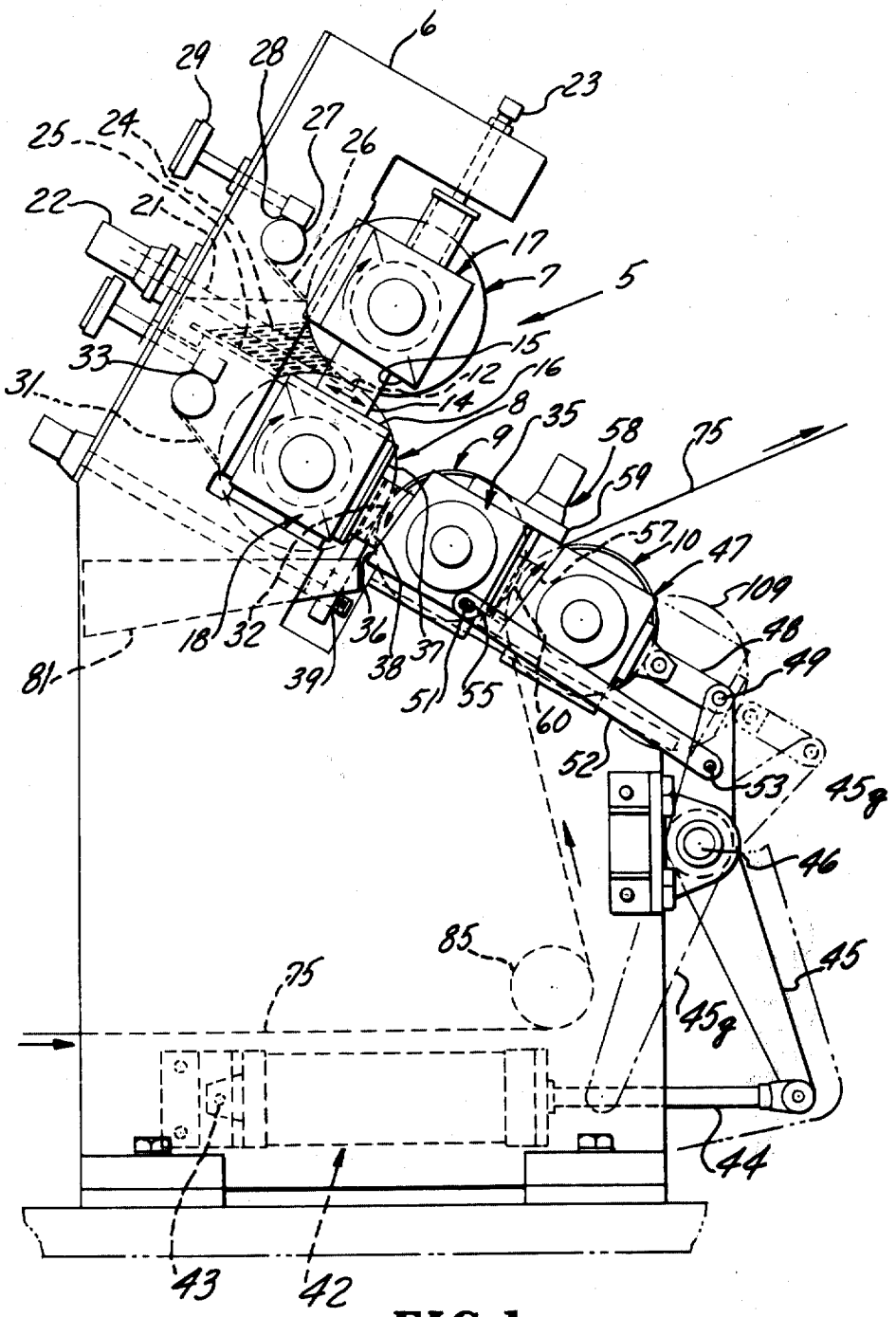
FIG. 1 is a schematic side elevation of a coating machine in accordance with the invention.

FIG. 1 illustrates a coating machine 5 having a frame 6, a metering roll 7, an applicator roll 8, a coating roll 9, and a backing roll 10 supported in the frame in adjustable relation with portions thereof. According to the construction shown, roll 8 may rotate about an axis in substantially fixed relation with the frame with rolls 7, 9 and 10 being in adjustable relation thereto.

Rolls 7 and 8 form a nip at 12 in which the spacing of the rolls 7, 8 is adjustable by movement of roll 7 toward and away from roll 8 through adjustment of a wedge 14 along relatively biased surfaces 15, 16 of bearing blocks 17, 18 providing radial support of rolls 7, 8, respectively, at the opposite ends thereof. Each wedge 14 is adjustable by a rod 21 in threaded relation therewith and a handle 22 mounted on the distal end of the rod. The roll 7 is anchored against movement away from the roll 8 by a pair of set screws 23 (one shown) in threaded relation with the frame 6 and bearing on each bearing block 17 at opposite ends of the roll 7.

A pond or body 24 of liquid may be supported as shown at the upstream side of nip rolls, 7, 8 by a dam 25 positioned between side walls of the frame 6 at a height sufficient o submerge the nip 12 of the rolls. As shown in FIG. 1, rolls 7, 8 both rotate clockwise and thus rotate in opposite directions through the nip 12 with roll 7 directed through the nip opposite to the downstream direction of movement of a coating material therethrough. To prevent carrying of liquid out of the pond 24 thereof by the roll 7, a doctor blade 26 engages the roll 7 at a level just above that of the liquid pond or that of the knife 25. The blade 26 is mounted on a rotary support 27 in bevel gear relation at 28 with an adjusting rod and knob assembly 29. Another doctor blade 31 engages a portion of the roll 8 along a portion thereof located in its direction of rotation away from the nip 32 of rolls 8, 9. The blade 31 is adjustable with respect to the surface of roll 8 by another bevel gear drive 33 and associated control assembly.

Roll 9 is supported at opposite ends by a pair of bearing blocks 35 (one shown) which have opposed surfaces 36 and biased relation with opposed surfaces 37 of bearing blocks 18. The bearing blocks 18 and 35 are separated along the relatively biased surfaces described by a pair of wedges 38 (one shown) traversable along the relatively biased surfaces 36, 37 by mechansim 39 similar to that already described with respect to wedges 14. Movement of the wedges 38 affects shifts of position of the assembly comprising rolls 9 and 10 toward and away from the roll 8.

In their major movements toward and away from the rolls 8, rolls 9, 10 are movable simultaneously by mechanisms, one at each side of the machine, comprising a fluid power cylinder assembly 42 hinged to the frame at 43 and having its piston rod portion 44 acting on a bell crank 45. The bell crank, pivoted on the main frame at 46 connects with one of two bearing blocks 47 at opposite ends of the rolls 10 through a linkage typified by link 48 connecting with the bell crank at 49. The bell crank 45 is also connected with the bearing block 35 at a trunnion 51 through a link 52 connected to the bell crank 45 by a pin 53. The link 52 is shown with a slot 55 for receiving the trunnion 51 so as to permit a small amount of free movement of the assembly comprising the roll 9 and its bearing blocks 35 relative to the assembly of roll 10 and its bearing blocks 47. Such free movement allows for adjustment of a wedge 57 adjustable through a handle and rod assembly 58 having its rod portion in threaded relation with the wedge 57. A bracket 59 secured to the bearing block 35 supports the wedge adjusting mechanism 58. Adjustment of the wedges 57, as provided by this arrangement, establishes the pressure of engagement of the two resilient rolls 9, 10 within the nip 60 thereof.

The arrangement just described permits rolls 9 and 10 to be withdrawn to positions corresponding to the ghost outlines 10*g* of the roll 10 and 45*g* of the bell crank 45. The mechanisms described, of course, are duplicated at opposite ends of the rolls. Slots 55 permit minor adjustment between rolls 9 and 10 at positions for operating as shown in full line.

Figure 2:
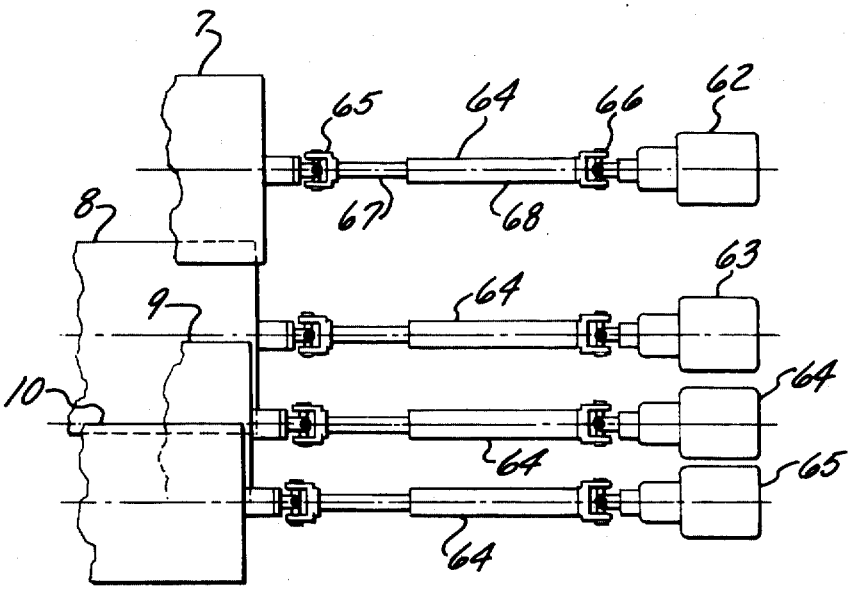
FIG. 2 is a rear fragmentary schematic elevation of rolls from the machine in FIG. 1 illustrating a separate power source for each roll.

FIG. 2 illustrates that the rolls 7, 8, 9, 10 are driven by separate driving means such as motor gear reduction units 62, 63, 64, 65, respectively. These units are connected with respective associated rolls through means, such as the extendable drive shaft 64 and universal joints 65, 66. The extendable shaft 64 may comprise complimentary spline shaft and sleeve elements 67, 68. It is desired that rolls 7, 8, 9, 10 be individually driven and that the nips between successive rolls be individually adjustable by the mechanisms hereinbefore described to enable the coater 5 to meet the widely different operating conditions arising out of the use of the machine for applying a variety of coating materials of a variety of types of webs.

The construction of the rolls is critical in the forming of ultra thin coatings. Rolls 7 and 8 may each be formed preferably of practically a solid block of metal except for a center bore capable of great resistance to deformation transversely to the axis of rotation. The surfaces of rolls 7 and 8 and the bearing structure within which the rolls are mounted are finished with a commercially obtainable accuracy of 0.0001 inches T.I.R., i.e., what is known in the trade as total indicator run out. Expressed another way, this means that the surfaces of rolls 7 and 8 are ground with such accuracy and the supporting bearing is fit with such accuracy that the gap between the two rolls within the nip thereof will not vary at any point along the nip more than about 0.0002 inches. Such roll accuracy is desired, e.g., in coating with very expensive resins such as silicone polymers. For less expensive resins, larger T.I.R. values may be tolerated.

The rolls 7 and 8 are constructed with such rigidity and hard finish as to be non-yielding and non-resilient along the nip 12, the roll 9, while constructed substantially as massively as rolls 7 and 8 to resist deformation perpendicular to its axis of rotation, comprises a rubber covering which is ground to an accurate diameter and has a hardness of around 90 as measured by a durometer on the Shore A scale. The roll 10 is of similar construction. Perimeter hardness of rolls 9 and 10 may vary in the range, e.g., of Shore A durometer values of 50 to 100 with values of around 90 presently preferred. Satisfactory machine operation is obtained, e.g., with rolls 7 and 8 having a diameter of 10 inches and rolls 9 and 10 having a diameter of 8½ inches.

Of great importance to the invention is the relative speeds of the rolls. Rolls 7 and 8 are operated at peripheral speeds regarded as quite slow in coating technology to avoid the introduction of air bubbles into the bath of liquid resin stored on the upstream side of the nip 12 over the dam 25.

Roll 7 has the slowest peripheral speed of the four rolls, i.e., a speed which may be in the range of four to twenty percent of that of the rolls 9 and 10 and typically in the lower portion of this range. For example, if it is assumed that a web 75 is carried through the nip of the rolls 9 and 10 at a thousand feet per minute, the roll 7 may be rotated at a speed of, e.g., 40 feet a minute through the nip 12 in a direction countercurrent to the direction of movement of coating material through the nip from the pond 24. The reason for movement of the material countercurrently to the peripheral motion of the roll 7 is that the roll 8 is necessarily traveling in the opposite direction through the nip at a greater peripheral speed. Typically for attaining very thin coatings, roll 8 may be rotated at speeds up to, e.g., five times the peripheral speed of roll 7, or up to 20 percent of the web speed or that of the peripheral speed of rolls 9 and 10. With rolls 7 and 8 rotating according to these speeds and directions, a coating material is conveyed through the nip 12 to form the layer 77 thereof on a downstream surface portion of roll 8. Layer 77 has a thickness slightly less than spacing of the rolls 7 and 8 within the nip 12. For example, if these rolls are spaced at 0.010 of an inch, the thickness of layer 77, would be expected to be of the order of approximately 0.009 of an inch.

Figure 3:
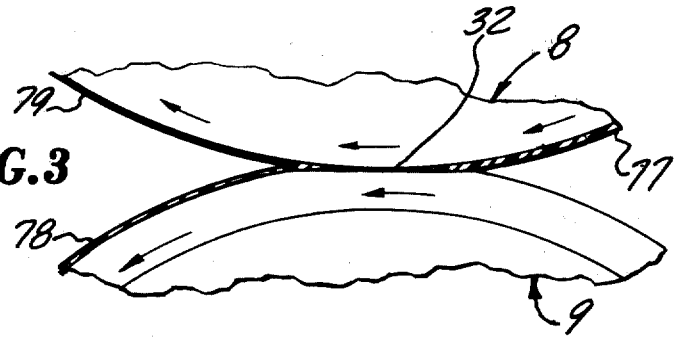
FIG. 3 is a fragmentary enlarged schematic view of a non-resilient applicator roll in nip relation with a resilient coating roll from the machine of FIGS. 1 and 2.
Figure 4:
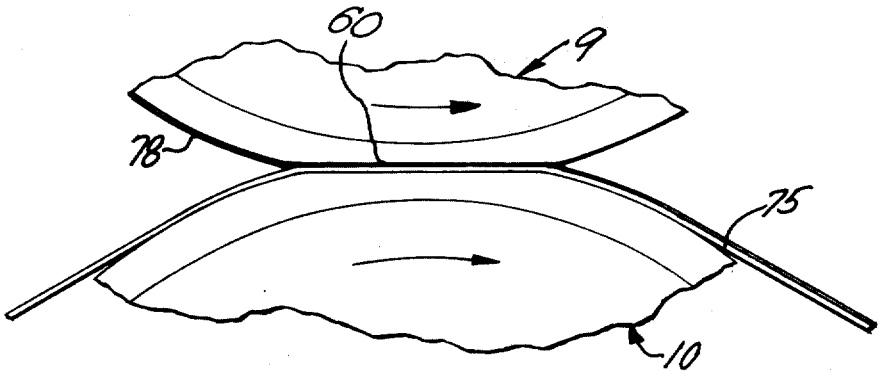
FIG. 4 is a fragmentary schematic elevation illustrating the resilient roll of FIG. 3 in nip relation with a resilient backing roll.

As indicated before, roll 9 rotates at a peripheral speed which may be in an approximate range of 5 to 25 times faster than the peripheral speed of roll 8. The manner of engagement is indicated in FIG. 3 wherein the surfaces of roll 8 along with the layer 77 thereon indents the resilient surface of roll 9. The coating enters the nip 32 and emerges therefrom as a layer 78 of reduced thickness on a surface portion of the roll 9 downstream from the nip 32. The thickness of layer 78 is slightly less than a thickness of layer 77 inversely proportional to the speed of the two rolls. Thus , in an approximate manner, the speed of roll 9 is greater than the speed of roll 8 by a factor substantially equal to the quotient of the thickness of layer 77 entering the nip 32 divided by the thickness of the layer 78 leaving the nip 32. Thus, if the thickness of layer 77 is 0.009 of an inch, than the thickness of layer 78 can be of the order of 0.0003 of an inch allowing for some of the coating carried into the nip 32 by the layer 77 to be carried away from the nip on the surface of roll 8 as layer 79. Layer 79 is stripped from the roll 8 by the doctor blade 31 and deposited into a catch pan 81 wherefrom it may eventually be returned to the pond 20.

The extensive area within which the coating material of the layer 77 is sandwiched between rolls 8 and 9 occurs as a result of adjustment of the wedges 38 and pressure exerted on the roll system by the fluid cylinder 32. The extent of this area may be varied by adjustment of the wedges and the fluid cylinder. Moreover, the coating material is subjected to substantial hydraulic pressure which tends to distribute the coating material within the nip 32 both transversely and lengthwise of the direction of movement of the material through nip. Any non-uniformity and thickness of the layer 77 is eliminated to a substantial extent by a passage through the nip 32 to produce a layer 78 of more uniform thickness. Any gas bubbles of the coating are dissipated as the coating 77 enters the nip.

The web 75 is routed through the machine by means, such as a roll 85, which causes the web 75 to engage an arcuate portion of the periphery of roll 10. Contact of the web with, e.g., 30° or 40° of the circumference of roll 10 assures good traction, and a wrinkle free non-scuffing relationship between the web and rolls 9, 10. The coating layer 78 carried to the web by roll 9 is, in general, deposited on or impressed into, the web 75. The portion of the surface of roll 9 advancing out of the nip 60 remains wet with coating material and returns a very small fraction of the coating layer 78 to the nip 32 of rolls 8, 9. To continue with the coating thicknesses referred to above as an example, a coating thickness of something less than 0.0003 of an inch is deposited on the web 75.

As the machine 5 includes the facilities herein described for adjusting roll pressures and speeds, it is obvious that an infinite number of roll pressures, nip gas settings, and roll speeds are possible in order to obtain ultra thin coatings varying substantially in viscosity. With the essential purpose of the invention, i.e., thin coatings in mind, the invention can be discerned from the above description as residing in method and apparatus which utilizes an indicated minimum number of rolls, a prescribed pattern of roll surfaces, and the indicated general pattern of relative roll speeds.

What is claimed is:

1. A method of coating a web comprising the steps of:

providing a pond of coating liquid having a viscosity up to 10,000 centipoises in upstream submerging relation with a first nip defining a gap of not less than about 0.0002 of an inch and not greater than about 0.015 of an inch formed between a first metallic roll and a second metallic roll, both rotatable to a surface accuracy within the first nip of less than 0.0001 of an inch;

passing said liquid downstream through said nip by rotating the first roll through said nip in an upstream direction and rotating said second roll through said nip in the downstream direction at a peripheral rate greater than that of said first roll;

passing the liquid carried on said second roll through a second nip formed by said second roll and a third roll having a resilient peripheral surface of a Shore A durometer hardness of approximately 90;

supporting said third roll in pressure nip relation with the second roll and rotating the third roll concurrently with the second roll through said second nip at a peripheral speed greater than that of said second roll by a factor substantially equal to the quotient of the thickness of material entering said second nip divided by the thickness of material leaving said nip;

passing the material carried away from said second nip through a third nip formed between said third roll and a fourth roll having resilient peripheral surface of a Shore A durometer hardness of approximately 90;

guiding a web through said third nip; and supporting the fourth roll in pressure nip relation with the third roll and rotating the fourth roll concurrently with the third roll through said third nip at the same peripheral speed as said third roll to receive and forward the web at said peripheral speed.

2. The method of claim 1 comprising:

guiding said web into third nip so as to cause it to be supported on an arcuate portion of the fourth roll adjacent said third nip to effect good traction of the web with the fourth roll.

3. Apparatus for coating webs comprising:

a first roll and a second roll oriented in nip relationship to receive and maintain a pond of coating material at the upstream side of the nip therebetween and at a height submerging said nip, both of said rolls being transaxially inflexible and finished to a hard surface of radial uniformity less than 0.0001 of an inch rendering said rolls capable of holding a constant nip gas while passing liquid having an absolute viscosity of up to 10,000 centipoises;

means for supporting said two rolls at a fixed nip gap;

means for driving the first roll through said nip in an upstream direction;

means for driving said second roll through said nip in the downstream direction at a peripheral rate greater than that of said first roll;

a third roll comprising a peripheral resilient material of a Shore A scale durometer hardness of approximately 90 supported in pressure nip relation with the second roll to form a second nip;

means for driving of a third roll concurrently with said second roll through said second nip at a peripheral speed substantially greater than that of the second roll;

a fourth roll comprising a peripheral resilient material of a Shore A scale durometer hardness of approximately 90 supported in pressure nip relation with said third roll to form a third nip; and means for driving said fourth roll concurrently with the third roll through said third nip at the same peripheral speed as said third roll, said third and fourth rolls being speedrated and adapted to receive the web and forward it at said peripheral speed through said third nip.

4. The apparatus of claim 3 wherein:

said first and second rolls are surface finished to approximately 0.0001 of an inch T.I.R.

5. The apparatus of claim 3 comprising:

guide means, a path through said apparatus over a circumferential portion of said fourth roll adjacent to, and leading into, said third nip.

6. The apparatus of claim 3 comprising:

doctor knife means for stripping a surface portion of the first roll leaving a region containing said pond; and doctor knife means for stripping a surface portion of said second roll leaving said second nip.

* * * * *